US005190347A

United States Patent [19]

Shiow-Lan

[11] Patent Number: 5,190,347

[45] Date of Patent: Mar. 2, 1993

[54] ADJUSTABLE FLEXIBLE BACK CUSHION WITH ADJUSTING BELTS AND ATTACHMENT BELT

[76] Inventor: Liou Shiow-Lan, 12F-3, No. 368, Sec. 1, Wen Huah 2Rd, Lin Loou Hsiang, Taipei, Taiwan

[21] Appl. No.: 788,280

[22] Filed: Nov. 5, 1991

[51] Int. Cl.[5] ..... A47C 7/02

[52] U.S. Cl. ..... 297/284.5; 297/254; 297/283; 297/231

[58] Field of Search ..... 297/284.5, 284 D, 284 C, 297/191, 224, 230, 231, 254–256, 283

[56] References Cited

U.S. PATENT DOCUMENTS

| | | | |
|---|---|---|---|
| 2,191,360 | 2/1940 | Westenbarger | 297/231 |
| 3,679,261 | 7/1972 | Slabakov | 297/231 |
| 4,597,386 | 7/1986 | Goldstein | 297/231 X |

FOREIGN PATENT DOCUMENTS

| | | | |
|---|---|---|---|
| 227544 | 1/1962 | Fed. Rep. of Germany | 297/259 |
| 1032588 | 6/1966 | United Kingdom | 297/255 |

*Primary Examiner*—Peter R. Brown
*Assistant Examiner*—James M. Gardner
*Attorney, Agent, or Firm*—Bacon & Thomas

[57] ABSTRACT

An adjustable flexible back cushion including a flexible protecting frame, a ventilating mesh, an upper pull belt, a lower pull belt, fasteners and elastic belt, wherein the protecting frame contains a flexible metal strip and the left and right sides thereof are curved while the lower portion thereof is bent rearward, and at least two pull belt assemblies each of which is composed of the upper and lower pull belts and the fasteners are dispowed on the protecting frame in vertical direction while the elastic belt is sewn on the protecting frame across over the pull belt assemblies, whereby the back cushion can be adjusted to eliminate a user's backache caused by improper sitting attitude, the back cushion being suitable for a car seat, office chair and general domestic chair.

4 Claims, 4 Drawing Sheets

ADJUSTABLE FLEXIBLE BACK CUSHION WITH ADJUSTING BELTS AND ATTACHMENT BELT

BACKGROUND OF THE INVENTION

Conventional back cushions have been developed for improving the functions of ventilation, slideproof, durability and for lowering the cost. However, no back cushion has been developed for elimination of the drawback of poor sitting attitude caused by improper design. Therefore, a back cushion which can be adjusted and which is light and ready for use is still needed.

SUMMARY OF THE INVENTION

It is an object of this invention to provide an abjustable flexible back cushion including a protecting frame containing a heat-treated flexible metal strip, and a ventilating mesh disposed in the protecting frame. The protecting frame is arch-shaped with its lower portion bent rearward. At least two pull belt assemblies are sewn between the upper and lower portions of the protecting frame in a vertical direction and at least one elastic belt is sewn between the left and right portions of the protecting frame across the pull belt assemblies. Each pull belt assembly is composed of an upper pull belt, a lower pull belt and a fastener, wherein the fastener secures the upper and lower pull belts togther such that the lower pull belt can be adjusted in tightness to change the curvature of the back cushion and enable the mesh to become concave or convex so as to correct the sitting attitude of a user and enable the user to avoid backache.

DETAILED DESCRIPTION OF THE PREFERRED EMBODIMENT

Figure 1:
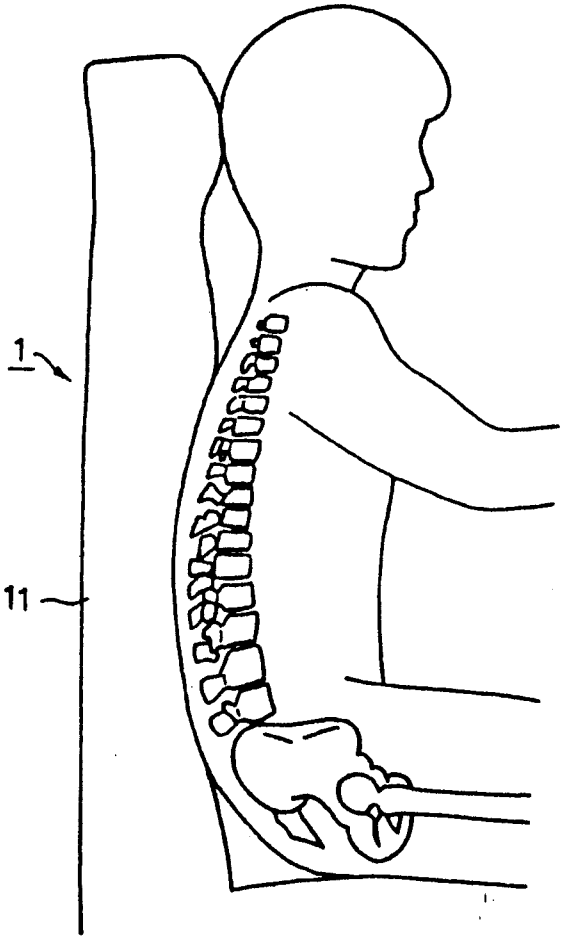
FIG. 1 (PRIOR ART)
FIG. 1 shows a conventional back cushion.

FIG. 1 shows a conventional back cushion 11 disposed on a chair 1. When a user leans on the cushion 11, the back of the user will be in a curved state. After a period of time in such attitude, the user always has an ache in his/her back.

Figure 2:
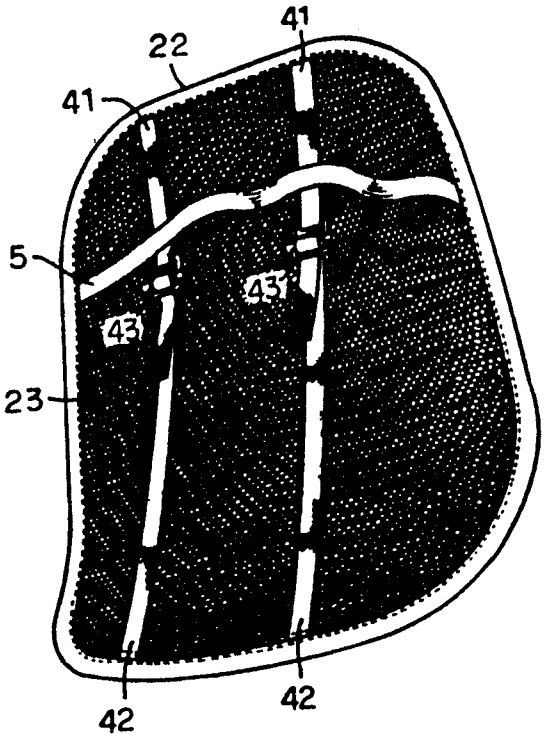
FIG. 2 is a perspective view of this invention.

Referring to FIG. 2, the back cushion of this invention includes a protection frame 22, a ventilation mesh 23, an upper pull belt 41, a lower pull belt 42, fasteners 43 and elastic belt 5, wherein the frame 22 is made of an unwoven fabric or nylon cloth containing a flexible metal strip. The metal strip 22 has been heat-treated and therefore possesses quite good flexibility. The flexible metal strip can be substituted with other flexible material such as rattan strip, etc.

The four corners of the frame 22 are arch-shaped. When seen from the top, the left and right sides of the frame 22 are smoothly curved while the lower portion thereof is bent rearward. The ventilation mesh 23 is sewn in the frame 22. The mesh 23 is made in such a manner that longitudinal and latitude nylon strings are crossed over one another to form a network which is extensile. The nylon strings can be replaced by other suitable materials, such as rattan strings, polyethylene plastic strings, etc.

Figure 4:
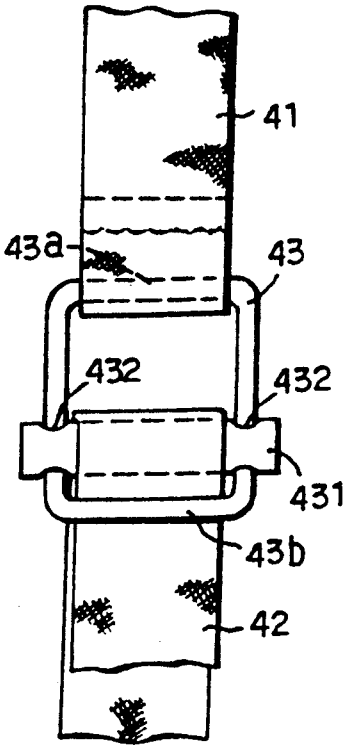
FIG. 4 is a front view according to FIG. 3.
Figure 3:
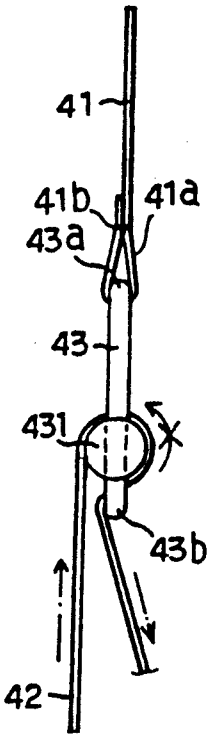
FIG. 3 is a side view of the pull belt assembly in a tight state.

Please refer to FIGS. 3 and 4. The upper pull belt 41, lower pull belt 42 and fasteners 43 constitute a pull belt assenbly, wherein the fastener 43 has a transverse rod member 431 two ends of which are respectively formed with two holes 432 through which the fasterner 43 goes. The upper pull belt 41 surrounds an upper frame 43*a* of the fastener 43 to be sewn by a wire 41*b* to form a ring 41*a*. The lower pull belt 42 surrounds the rod member 431 and extends outward under a lower frame 43*b* of the fastener 43. The lower pull belt 42 is not formed with any ring and is in a loose state. However, when the lower pull belt 42 is pulled downward, the rod member 431 and the lower frame 43*b* will very tightly compress the lower pull belt 42 to fix the same, making the lower pull belt 42 unable to be moved back. At least two such belt assemblies are disposed preferably in vertical direction.

Figure 5:
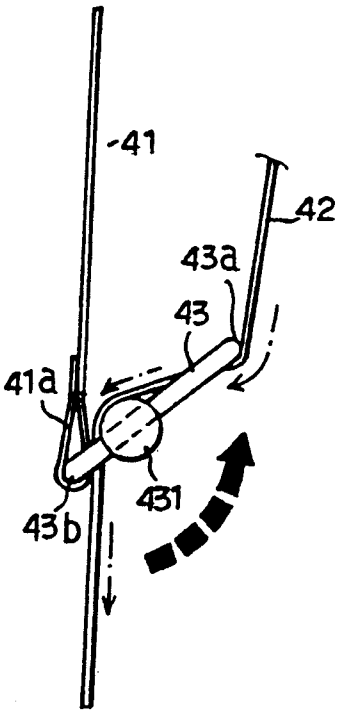
FIG. 5 is a side view of the pull belt assembly in a loose state.

Please now refer to FIG. 5. When the lower pull belt 42 is to be loosened, the same can be pulled upward to rotate the fastener 43 and separate the rod member 431 from the lower frame 43*b* of the fastener 43. As a result, the rod member 431 and the lower frame 43*b* do not clamp the lower pull belt 42 and permit the same to recover to a normal state.

Figure 6:
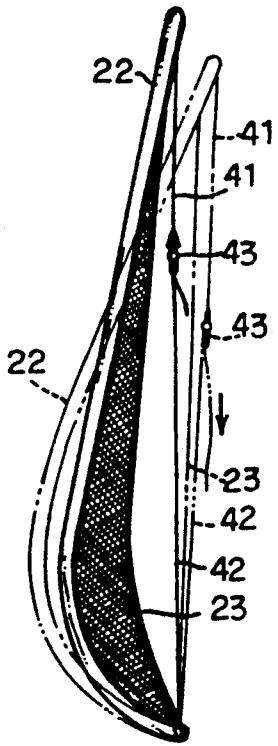
FIG. 6 shows the adjustment of the back cushion.

In FIG. 6, the solid lines show a back cushion in normal state while the dash lines show a back cushion wherein the lower pull belt 42 is pulled downward to shorten the length thereof. At this time, the lower portion of the flexible protecting frame 22 will be further bent rearward with the mesh 23 more convex forward. The more tightly the lower pull belt 42 is pulled, the more the frame 22 is bent.

Figure 7:
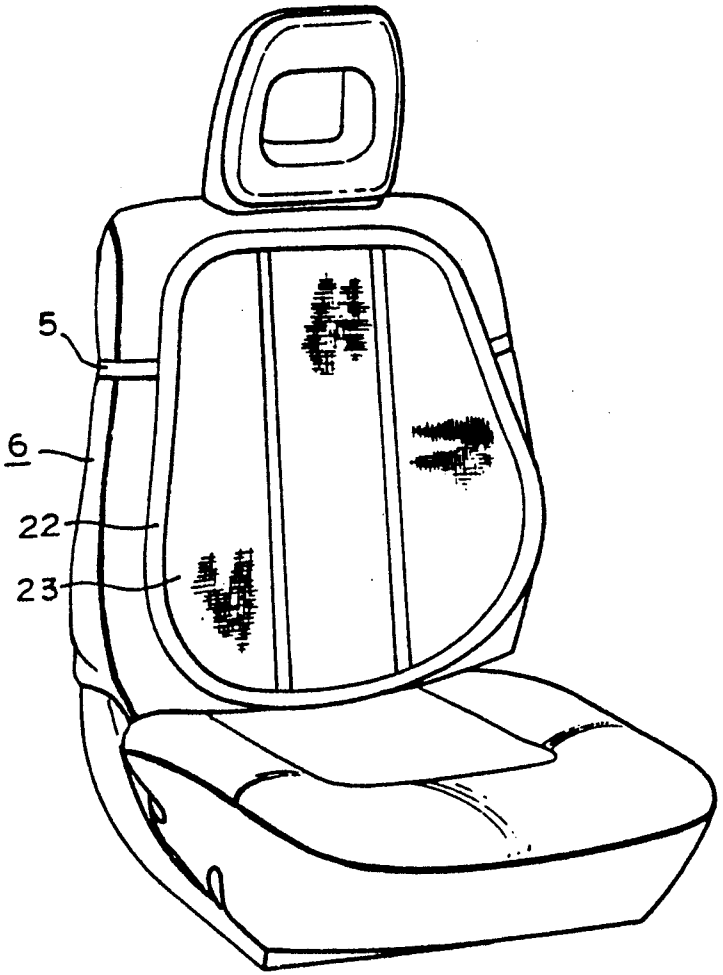
FIG. 7 shows the application of this invention.

Please refer to FIG. 7. The cushion of this invention is suitable for any kind of chair, especially for a soft chair. By means of the elastic belt 5, the cushion can be secured to the back of a car seat 6. The position of the cushion can be adjusted by changing the location of the elastic belt 5 is disposed across the pull belt assemblies.

Figure 8:
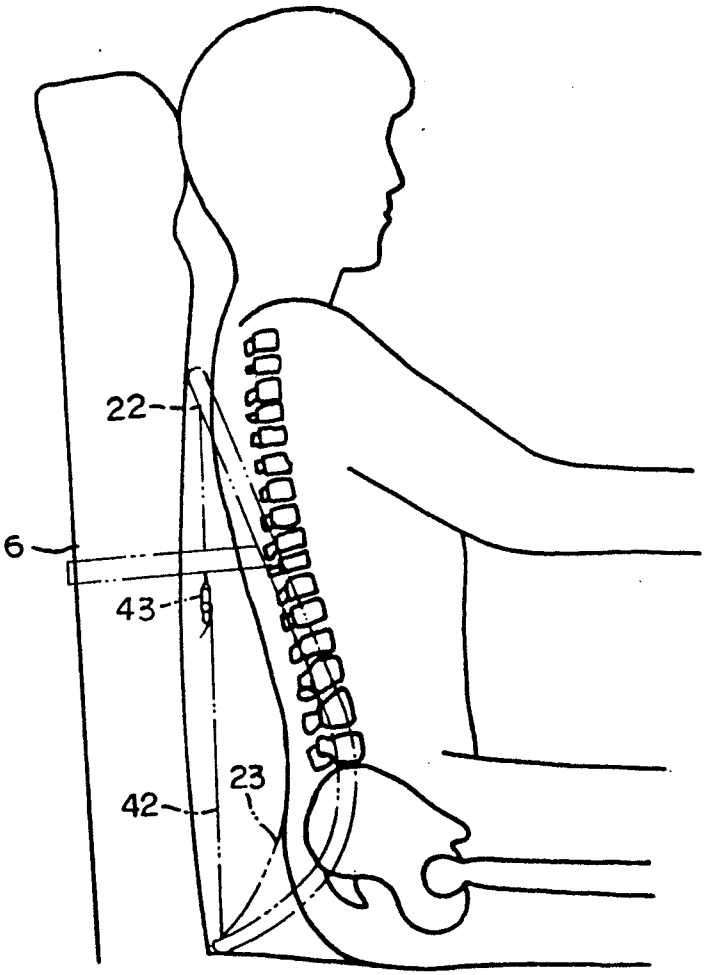
FIG. 8 shows the application thereof on a chair.

FIG. 8 shows the application of this invention, wherein the convex mesh 23 enables a driver to sit with his/her back straight so as to eliminate the back ache that takes place after a period of sitting time.

Figure 9:
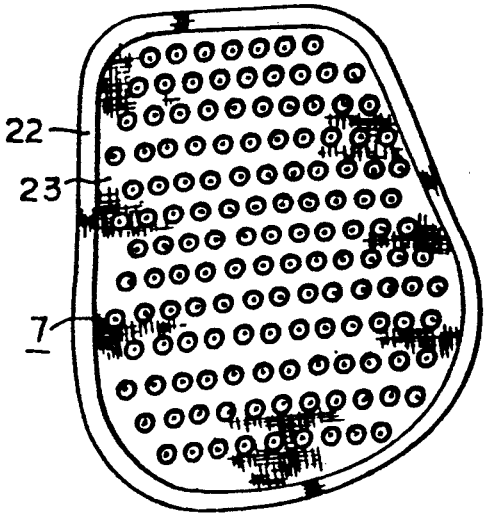
FIG. 9 shown another embodiment of this invention.
Figure 10:
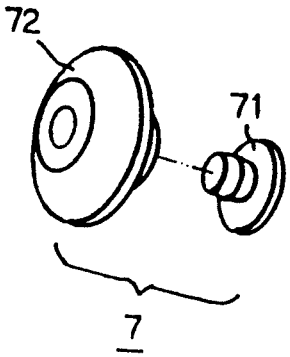
FIG. 10 is an exploded view of the massage bead thereof.

FIG. 9 shows another embodiment of this invention, wherein the ventilation mesh 23 has check-shaped or beehive-shaped structure or the like and on the surface thereof are disposed multiple massage beads 7. Each bead 7 is composed of a male button 71 and a female button 72 as shown in FIG. 10. The female button 72 is larger than the male one 71 and has a central hole. The female button 72 is disposed on the front surface of the ventilating mesh 23 with the male button 71 extending through the mesh 23 from the rear side thereof and inserted into the hole of the female button 72. Such arrangement can achieve the functions of ventilation and slideproof and avoiding backache.

What is claimed is:

1. An adjustable flexible back cushion comprising:

a) a flexible protecting frame having upper, lower and opposite side portions;

b) a ventilation mesh attached to the frame;

c) at least one elastic belt attached to opposite side portions of the frame adapted to fasten the back cushion to a back of a seat;

d) at least two curvature adjusting pull belt assemblies, each belt assembly comprising:

i) an upper belt having a first end attached to the upper portion of the frame and a second end;

ii) a lower belt having a first end attached to the lower portion of the frame and a second end;

iii) adjustable fastening means attaching the second ends of the upper and lower belts together comprising:

a ring member attached to the second end of one of the upper and lower belts; and a rod member slidably attached to the ring member and adapted to engage the second end of the other of the upper and lower belts, the rod movable between a clamping position wherein the second ends are affixed to each other and a released position wherein the second ends are adjustable relative to each other.

2. The adjustable flexible back cushion of claim 1 wherein the flexible protecting frame comprises a metal strip.

3. The adjustable flexible back cushion of claim 1 wherein the flexible protecting frame comprises a rattan strip.

4. The adjustable flexible back cushion of claim 1 wherein the flexible protecting frame comprises a bamboo strip.

* * * * *